US005945244A

United States Patent [19]

Barbetta et al.

[11] Patent Number: 5,945,244

[45] Date of Patent: Aug. 31, 1999

[54] COATED CARRIER

[75] Inventors: Angelo J. Barbetta, Penfield; Robert D. Bayley, Fairport; Carol A. Fox, Canandaigua; Thomas R. Hoffend, Webster; Scott M. Silence, Fairport; K. Derek Henderson, Rochester, all of N.Y.

[73] Assignee: Xerox Corporation, Stamford, Conn.

[21] Appl. No.: 09/140,437

[22] Filed: Aug. 26, 1998

[51] Int. Cl.[6] ..... G03G 9/113

[52] U.S. Cl. ..... 430/106.6; 430/108; 430/137

[58] Field of Search ..... 430/108, 106.6, 430/137

[56] References Cited

U.S. PATENT DOCUMENTS

| | | | |
|---|---|---|---|
| 3,533,835 | 10/1970 | Hagenbach et al. | 117/217 |
| 3,590,000 | 6/1971 | Palermiti et al. | 252/62.1 |
| 3,658,500 | 4/1972 | Hagenbach | 65/21 |
| 3,798,167 | 3/1974 | Kukla et al. | 252/62.1 |
| 3,918,968 | 11/1975 | Kukla et al. | 96/1.5 D |
| 3,922,382 | 11/1975 | Kukla et al. | 427/58 |
| 3,939,086 | 2/1976 | Hagenbach | 252/62.1 P |
| 4,020,192 | 4/1977 | Nozaki | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,298,672 | 11/1981 | Lu | 430/108 |
| 4,310,611 | 1/1982 | Miskinis | 430/107 |
| 4,338,390 | 7/1982 | Lu | 430/106 |
| 4,397,935 | 8/1983 | Ciccarelli et al. | 430/110 |
| 4,434,220 | 2/1984 | Abbott et al. | 430/108 |
| 4,560,635 | 12/1985 | Hoffend et al. | 430/106.6 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,202,210 | 4/1993 | Matsuoka et al. | 430/108 |
| 5,376,494 | 12/1994 | Mahabadi et al. | 430/137 |

*Primary Examiner*—Christopher D. Rodee
*Attorney, Agent, or Firm*—E. O. Palazzo

[57] ABSTRACT

A carrier comprised of a core and thereover a polymer of styrene, an olefin and a dialkylaminoalkyl methacrylate.

29 Claims, No Drawings

COATED CARRIER

PENDING APPLICATIONS

Illustrated in copending applications U.S. Ser. No. 09/140,524; U.S. Ser. No. 09/140,439; U.S. Ser. No. 09/140,439, and U.S. Ser. No. 09/140,998; all filed concurrently herewith, and the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in copending application U.S. Ser. No. 09/140,524 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in copending application U.S. Ser. No. 09/140,594 a carrier comprised of a core and thereover a polymer or polymers of (1) methylmethacrylate and a monoalkyl aminoalkyl methacrylate, or (2) a polymer or polymers of methylmethacrylate and dialkylaminoalkyl methacrylate; in copending application U.S. Ser. No. 09/140,439 a carrier comprised of a core and a polymer coating of (1) styrene/monoalkylaminoalkyl methacrylate or (2) styrene/dialkylaminoalkyl methacrylate; and in copending application U.S. Ser. No. 09/140,998 a carrier comprised of a core and a polymer coating containing a quaternary ammonium salt functionality.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions comprised of a core and thereover terpolymers, for example terpolymers of styrene, an olefin, especially a diolefin, and an alkyl amine methacrylate or acrylate.

In embodiments of the present invention, the carrier particles are comprised of a core with a coating thereover of terpolymers, such as terpolymers of styrene, butadiene and dimethylaminoethyl methacrylate, terpolymers of styrene, butadiene and alkyl aminoethyl methacrylates or acrylates with alkyl amine groups higher in carbon chain length than methyl, such as t-butylaminoethyl methacrylate, diethylaminoethyl methacrylate, diisopropylaminoethyl methacrylate, and the like. The carrier may include the polymer coating thereover in admixture with other suitable polymers, and more specifically, with a suitable known second polymer, such as a fluoropolymer, polymethylmethacrylate, poly (urethane), especially a crosslinked polyurethane, such as a poly(urethane)polyester and the like, and moreover, the polymer coating may contain a conductive component, such as carbon black, and which conductive component is preferably dispersed in the polymer coating. With the conductive component, there is enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, a triboelectrical charge, for example a carrier tribo range of from about a plus (positive charge) 50 to about 150, or to about 95 microcoulombs per gram, and preferably from about a positive 55 to about a positive 90 microcoulombs per gram, and most preferably from a positive about 60 to a positive about 70 microcoulombs per gram.

The carrier particles of the present invention can be selected for a number of different xerographic copiers and printers, such as high speed color xerographic copiers, printers, digital copiers, and more specifically, wherein colored copies with excellent image resolution and substantially no background deposits are achievable in copiers, printers, digital copiers, and the combination of xerographic copiers and digital systems. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core, and the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith.

Carrier particles for use in the development of electrostatic latent images are described in many patents including, for example, U.S. Pat. No. 3,590,000. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where part of, or the entire coating may separate from the carrier core in the form of chips or flakes, and fail upon impact, or abrasive contact with machine parts and other carrier particles. These flakes or chips, which cannot generally be reclaimed from the developer mixture, usually adversely affect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low tribo as compared to the high tribo carriers of the present invention.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. Advantages of the invention of the present application as compared to this prior art are, for example, the achieving of high positive triboelectric charge on the carrier particles, that is, high negative triboelectric charge is imparted to the toner particles developed onto a photoreceptor in a xerographic development environment, the full range of electrical properties of the carrier particles can be achieved at high triboelectric charging values, from carrier conductivities of $10^{-17}$ mho/cm to $10^{-6}$ mho/cm, that is, from the insulative to the conductive regime, the tribo and conductivity can be preselected, and excellent image quality is obtainable.

With further reference to the prior art, carriers obtained by applying insulating resinous coatings to porous metallic carrier cores using solution coating techniques are undesirable from many perspectives. For example, the coating material will usually reside in the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high triboelectric charging values with finely divided toner particles; and also wherein the carrier particles in embodiments are of substantially constant conductivity.

When resin coated carrier particles are prepared by powder coating process, the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of from a positive triboelectric charge of positive about 20 to a positive of about 150, and for example, from a positive about 45 to a positive about 90 microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles and having contained therein conductive particles of, for example, carbon black.

Other U.S. Patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing a polymer, or polymer coating.

In another feature of the present invention there are provided dry coating processes for generating carrier particles of substantially constant conductivity parameters.

In yet another feature of the present invention there are provided dry coating processes for generating carrier particles of substantially constant conductivity parameters, and excellent triboelectric charging values.

In yet a further feature of the present invention there are provided carrier particles with high triboelectric values of at least about 20 to about 40 microcoulombs per gram, and wherein the carrier includes thereover a terpolymer or a coating of two polymers; a terpolymer of styrene and poly(urethane), and wherein the coating may contain therein a conductive component of, for example, carbon black.

Aspects of the present invention include a carrier comprised of a core, and thereover a polymer of styrene, an olefin and a dialkylaminoalkyl methacrylate; a carrier wherein said olefin is a diolefin; a carrier wherein said olefin is of the formula $CH_2{=}CR{-}CHR{=}CH_2$ where R is independently H or alkyl.; a carrier wherein said alkyl contains from about 4 to about 6 carbon atoms; a carrier wherein said diolefin is 1,3-butadiene, isoprene, 2-methyl-1,3-butadiene, or 2,3-dimethyl-1,3-butadiene; a carrier wherein alkyl contains from about 1 to about 6 carbon atoms; a carrier wherein said polymer is a terpolymer of styrene, butadiene and di-dimethylaminoethyl methacrylate; a carrier wherein the polymer is a terpolymer of styrene, butadiene and diisopropylaminoethyl methacrylate, a terpolymer of styrene, butadiene and diethylaminoethyl methacrylate, a terpolymer of styrene, butadiene and t-butylaminoethyl methacrylate, a terpolymer of styrene, isoprene, and dimethylaminoethyl methacrylate, or a terpolymer of styrene, 2,3-dimethyl-1,3-butadiene and diisopropylaminoethyl methacrylate; a carrier wherein the polymer molecular weight $M_w$ is from about 30,000 to about 700,000, and wherein the number average molecular weight $M_n$ is from about 20,000 to about 300,000 as measured by Gel Permeation Chromatography; a carrier wherein the polymer contains from about 75 to about 90 weight percent of styrene, from about 5 to about 15 weight percent of butadiene, and from about 2 to about 20 weight percent of said methacrylate; a carrier wherein the polymer is of an $M_w$ of about 20,000 to about 800,000, and of an $M_n$ of from about 12,000 to about 350,000; a carrier wherein the polymer coating weight is from about 0.1 to about 20 weight percent, and the carrier size is from about 50 to about 200 microns in volume average diameter; a carrier wherein the polymer coating weight is from about 1 to about 3 weight percent; a carrier wherein the polymer contains a conductive; a carrier wherein the conductive component is a metal oxide, or is carbon black, and the carrier conductivity ranges from about $10^{-15}$ mho/cm to about $10^{-6}$ mho/cm; a carrier wherein said conductive component is carbon black selected in an amount of from about 10 to about 60 weight percent, and the conductivity thereof is from about $10^{-10}$ mho/cm to about $10^{-7}$ mho/cm; a carrier wherein said core is a metal, a metal oxide, a ferrite, or mixtures thereof; a carrier with a triboelectric charge on the carrier of from about a positive 20 to about a positive 100 microcoulombs per gram, or with a triboelectric charge of from about a positive 20 to about a positive 70 microcoulombs per gram; a developer comprised of the carrier and toner; a developer wherein the toner is comprised of thermoplastic resin and colorant; a developer wherein the colorant is a pigment, or a dye; a developer comprised of a (1) carrier core and a coating layer thereover of a terpolymer of styrene, an olefin, and dimethylaminoethyl methacrylate, and (2) a toner; a developer wherein the carrier core is iron or a ferrite, and said olefin is optionally butadiene; a developer with a carrier triboelectric charge of from about a positive 50 to about a positive 75 microcoulombs per gram, and a toner triboelectric charge of from about a negative 50 to about a negative 75 microcoulombs per gram, or with a carrier triboelectric charge of from about a positive 60 to about a positive 70 microcoulombs per gram and a toner triboelectric charge of from about a negative 60 to about a negative 70 microcoulombs per gram; a carrier composition in accordance with claim 1 containing a second polymer; a carrier wherein the second polymer is a fluoropolymer, a styrene polymer, a styrene acrylate copolymer, or a styrene methacrylate copolymer; a carrier wherein said second polymer is comprised of a polyurethane, or polymethylmethacrylate; a carrier wherein said core is a metal of spherical steel or atomized steel, a metal oxide of magnetite, a ferrite of Cu/Zn-ferrite, Ni/Zn-ferrite, Sr (strontium)-ferrite, or Ba-ferrite; an imaging process comprising the development of an image with the developer; a process for the preparation of carrier which comprises the mixing of a core and the polymer; and carrier particles prepared by mixing low density porous magnetic, or magnetically attractable metal core carrier particles with from, for example, between about 0.05 percent and about 3 percent by weight, based on the weight of the coated carrier particles, of the terpolymer, and which polymer may optionally contain dispersed therein carbon black or a similar conductive component until adherence thereof of the polymer to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter; a composition comprised of a core, and thereover a terpolymer present in an amount of from about 0.05 to about 5 weight percent of the total carrier composition, and which terpolymer may optionally contain a conductive component, such as a metal oxide, or a pigment like conductive carbon black, wherein the conductive component is selected in an amount of from about 10 to about 75 weight percent, and preferably from about 15 to about 50 weight percent, based on the sum of the terpolymer and conductive component; a carrier with two polymers thereover, wherein the first polymer is a terpolymer of styrene, a diolefin, and a dialkylaminoalkyl methacrylate, and wherein the conductive component for either the first or second polymer is a metal oxide, or a pigment like preferably carbon black, wherein the conductive component is carbon black selected in an amount of from about 10 to about 50 weight percent; wherein the second polymer is as illustrated herein, that is for example, a fluorocarbon, polymethylmethacrylate (PMMA), a thermosetting polymer such as a thermosetting polyurethane, a polyester, a styrene based polymer, and wherein the first polymer is selected in an amount of from about 1 to about 100, or from about 10 to about 75 weight percent, based on the total weight of all polymers and conductive components present in the carrier, and the second polymer is selected in an amount of from about 99 to about 0, or from about 90 to about 25 weight percent, based on the total weight of all polymers and conductive components present in the carrier; and wherein the carrier core is a metal, a ferrite, a metal oxide, and the like, such as known carrier cores.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also, of value with regard to the carrier core properties are, for example, suitable magnetic characteristics that will permit magnetic brush formation in magnetic brush development processes; and also wherein the carrier cores possess desirable mechanical aging characteristics; and also, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D. M. Steward Corporation or Powdertech Corporation, Ni/Zn-ferrite available from Powdertech Corporation, Sr (strontium)-ferrite containing, for example, about 14 percent strontium oxide and 86 percent iron oxide and available from Powdertech Corporation, and Ba-ferrite, magnetites, available for example from Hoeganaes Corporation (Sweden), nickel, mixtures thereof, and the like. Preferred carrier cores include ferrites, and sponge iron, or steel grit with an average particle size diameter of from between about 30 microns to about 200 microns.

Examples of terpolymers selected for the carrier include terpolymers of styrene, a diolefin containing, for example, from about 4 to about 6 carbon atoms, such as butadiene and/or isoprene, and a monoalkyl, or dialkyl amine, such as a dimethylaminoethyl methacrylate, diethylaminoelhyl methacrylate, diisopropylaminoethyl methacrylate, or t-butylaminoethyl methacrylate; terpolymers of methylmethacrylate, such as those of methyl methacrylate, a diolefin containing from about 4 to about 6 carbon atoms, such as butadiene and/or isoprene and a monoalkyl, or dialkyl amine, such as a dimethylaminoethyl methacrylate, diethylaminoethyl methacrylate, diisopropylaminoethyl methacrylate, or t-butylaminoethyl methacrylate, and the like. Specific examples of polymer coatings are poly (styrene/butadiene/dimethyl aminoethyl methacrylate), poly (styrene/butadiene/tertiary-butylaminoethyl methacrylate), poly(styrene/butadiene/diethyl aminoethyl methacrylate), poly(styrene/butadiene/diisopropylaminoethyl methacrylate), terpolymers of styrene/butadiene, styrene/isoprene or styrene/2,3-dimethyl-1,3-butadiene with other monoalkyl or dialkylaminoethyl methacrylates, poly(methyl methacrylate/butadiene/dimethylaminoethyl methacrylate), poly(methyl methacrylate/butadiene/tertiary-butylaminoethyl methacrylate), poly(methyl methacrylate/butadiene/diethylaminoethyl methacrylate), poly(methyl methacrylate/butadiene/diisopropylaminoethyl methacrylate), terpolymers of methyl methacrylate/butadiene, methyl methacrylatelisoprene or methyl methacrylate/2,3-dimethyl-1,3-butadiene with other monoalkyl or dialkylaminoethyl methacrylates, wherein alkyl contains, for example, from about 1 to about 25, and preferably from 1 to about 10 carbon atoms, such as methyl, ethyl, n-propyl, butyl, isopropyl, pentyl, decyl, pentadecyl, eicosyl and pentacosyl, and the like with methyl, ethyl, and isopropyl being preferred.

The terpolymers possess various suitable molecular weights, such as for example a weight average molecular weight of from about 20,000 to about 800,000, and a number average molecular weights of, for example, from about 12,000 to about 350,000 as measured by Gel Permeation Chromatography with preferred molecular weights $M_w$ of from about 30,000 to about 700,000 and number average molecular weights of from about 20,000 to about 300,000 as measured by Gel Permeation Chromatography.

The monomers for synthesizing the above polymers are obtained from Aldrich Chemical Company with regard to styrene, dimethylaminoethyl methacrylate, diethyl aminoethyl methacrylate, and methylmethac rylate, and Scientific Polymer Products with regard to diisopropylaminoethyl methacrylate and t-butylaminoethyl methacrylate. Synthetic methods for the preparation of polymers and copolymers from these monomers may be by bulk polymerization, solution polymerization, emulsion polymerization, suspension or semisuspension polymerization or any other known suitable polymerization methods.

The polymers can also be prepared by bulk polymerization, which can be accomplished with monomers in the absence of solvent, and by solution polymerization, can be effected in a solvent medium such as toluene in which the monomer or mixture of monomers is combined with a suitable initiator such as 2,2'-azobis(2-methylpropionitrile), refered to as AIBN, and reacted for an effective period of time, for example from about 7 to about 15, and preferably about 11 hours, at an elevated temperature, for example 70° C. From this reaction, a solution with a solids content of about 22.7 percent by weight polymer can be obtained, in which the polymer has a glass transition of about 108.0° C., and molecular weight by gel permeation chromatography of $M_w$=90,000 with molecular weight dispersibility, that is the ratio of $M_w/M_n$, or MWD=about 2.3.

The suspension polymerization method involves mixing monomers and initiator, such as AIBN, to obtain a clear organic phase. The organic phase is then combined with an aqueous solution of Air Products Airvol 603 Polyvinyl Alcohol, and potassium iodide aqueous phase inhibitor. The desired particle size is obtained by homogenizing the two phases with a Brinkman homogenizer equipped with a Polytron Generator with three stationary and three moving rings of flat rotor design for five minutes at about 8,000 RPM. The resulting suspended organic phase is then transferred to the preheated reactor and stirred at about 65 RPM to maintain stability of the suspension. The suspension is then maintained at 70° C. for 6 hours and 40 minutes to complete polymerization. The polymer suspension is then cooled, removed from the reactor, washed and centrifuged 5 times with a 90/10 volume ratio of methanol/water and finally washed with water only. The wet polymer suspension is then air dried, placed in a vacuum oven at from about 40.0° C. to 80.0° C. to complete drying, and further broken down to its primary particle size by ball milling followed by screen sieving. This process yields a polymer particle size having a volume median of about 4.0$\mu$, a second pass glass transition onset temperature of 95.8° C., and a molecular weight by gel permeation chromatography of about $M_w$=520,000 with an about MWD=2.2

Emulsion polymerization is accomplished by the continuous addition to a suitable reaction vessel containing water, and providing mechanical stirring, nitrogen atmosphere, and thermostatic control, a mixture of monomers and an initiator, such as ammonium persulfate initiator, as obtained from the Aldrich Chemical Company, (0.2 to 0.6 percent by weight of monomers). The polymerization effected by heating to, for example, between about 55° C. and about 65° C. to achieve molecular weights, $M_w$ by gel permeation chromatography ranging from, for example, about 200,000 to about 500,000. The polymer or copolymer powder is isolated by freeze drying in vacuo, the residue free latex. The resulting polymer particle diameter size is, for example, 0.1 to 2.0 microns in volume average diameter.

The polymer coating preferably has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E. I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)] chromate(1-), ammonium sodium and hydrogen (TRH), cetyl pyridinium chloride (CPC), FANAL PINK® D4830, and the like, including those as specifically illustrated herein, and other effective known charge agents or additives. Specific negative charge additives, that is additives that assist in charging the toner to a negative polarity, are, for example, E 84™ zinc complex of 3,5-ditertiary butyl salicylic acid and E-88™ tris(3,5-ditertiary butyl salicylato) aluminum, which are commercially available from Orient Chemical Company, TRH ammonium bis[1-(3,5-dinitro-2-hydroxy phenyl) azo-3-(N-phenylcarbamoyl)-2-naphthalenolate] chromate; U.S. Pat. No. 4,433,040, which is commercially available from Hodogaya Chemicals, aluminum complexes such as those disclosed in U.S. Pat. No. 5,324,613 and hydroxy bis(3,5-di-tertiary butyl salicylic) aluminate monohydrate disclosed in U.S. Pat. No. 5,223,368, the disclosures of each of these patents being totally incorporated herein by reference. The charge additives are selected in various effective amounts, such as from about 0.05 to about 15, and from about 0.1 to about 3 weight percent, based on the sum of the weights of all the toner components, such as the components of polymer, conductive additive, and charge additive components. Addition of various known charge enhancing additives can act to further increase the positive triboelectric charge imparted to the carrier, and therefore, further increase the negative triboelectric charge imparted to the toner in a xerographic development subsystem.

Examples of second polymers selected can include polymethacrylates or acrylates, polyurethanes, fluorocarbon polymers, such as polyvinylidenefluoride, polyvinylfluoride, and polypentafluorostyrene, polyethylene, polyethylene-co-vinylacetate, polyvinylidenefluoride-co-tetrafluoroethylene, and the like. Other known related polymers not specifically mentioned herein may also be selected, such as those illustrated in the U.S. Pat. No. 4,937,166 and 4,935,326 patents mentioned herein.

Another second polymer is comprised of a thermosetting polymer, more specifically, a poly(urethane) thermosetting resin, which contains, for example, from about 75 to about 95, and preferably about 80 percent by weight of a polyester polymer, which, when combined with an appropriate crosslinking agent, such as isopherone diisocyannate and initiator such as dibutyl tin dilaurate forms a crosslinked poly(urethane) resin at elevated temperatures. An example of a polyurethane is poly(uretharie)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

The advantages of the carriers of the present invention include in embodiments high robust carrier tribo charge of a positive value, high toner tribo charge of a negative value, excellent admix, for example, from about 1 to about 30 seconds as determined in the charge spectrograph, and the like.

Various effective suitable processes can be selected to apply the polymer, or polymer mixture, for example from 2 to about 5, and preferably 2 polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bec, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, melhylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of, for example, from about 1 percent by weight to about 20, and preferably from about 5 to about 12 percent by weight, based on the total weight of the toner components, however, lesser or greater amounts of pigment may be selected. Colorants include dyes, pigments, mixtures thereof, mixtures of dyes, mixtures of pigments, and the like.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like can be selected. These colorants, especially pigments are generally present in the toner composition in an amount of from about 1 weight percent to about 15, and for example, from about 2 to about 12 weight percent based on the weight of the toner components of binder and pigment.

For further enhancing, the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Toner particles sizes and shapes are known and include for example a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with this developer composition possess, for example, acceptable solids, excellent halftones, and desirable line resolution with acceptable or substantially no background deposits excellent chroma, superior color intensity, constant color chroma and intensity over extended time periods, such as 1,000,000 imaging cycles, and the like.

The following Examples are being provided to further illustrate the present invention, it being noted that these Examples are intended to illustrate and not limit the scope of the present invention. Parts and percentages are by weight unless otherwise indicated.

EXAMPLE I

In the first step of the carrier coating process, a terpolymer obtained from Goodyear Tire and Rubber Company of 84.75 percent by weight styrene, 10.5 percent by weight butadiene, and 4.75 percent by weight dimethylaminoethyl methacrylate, with a molecular weight $M_w$ of 51,500, an $M_n$ of 15,800, and an MWD of 3.3, was ground down to a volume median average particle size of 5.3 microns in a 15" Sturtevent jet mill, under a 120 psi feed pressure, a 120 psi gring pressure, and educt-limited (grinder has the material in a feed hopper that meters the material into an eductor. The eductor basically sucks the material into the grinder. The eductor has a funnel on it that the material from the feed hopper falls into) feeding. 44.91 Grams of the resulting polymer powder, poly(styrene-co-butadiene-co-dimethylaminoethyl methacrylate) in a 84.75/10.5/4.75 weight percent monomer ratio was then mixed with 4,491.09 grams of a spherical steel core with a volume median diameter of 100 microns (Nuclear Metals, Inc.). The mixing was accomplished in a M5R blender with the following process conditions: blender speed of 50 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 350° F. thereby causing the polymers to melt and fuse to the core. The product from the kiln was screened through an 84 TBC (Tensile Bolt Cloth) mesh screen to remove any large agglomerates. The final product was comprised of a carrier core with a total of 1.0 percent coating weight polymer of poly(styrene-co-butadiene-co-dimethylaminoethyl methacrylate) (84.75 percent/10.5 percent/4.75 percent monomer ratio) by weight on the surface.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol-A propylene oxide fumarate polymer, and about 8 weight percent of REGAL 330® carbon black. Thereafter, the triboelectric charge on the carrier particles was determined by the known Faraday Cage process, and there was measured on the carrier a charge of 18.4 microcoulombs per gram. Further, the conductivity of the carrier as determined by forming a 0.1 inch long magnetic brush of the carrier particles, and measuring the conductivity by imposing a 10 volt potential across the brush was too insulating to be measured ($>10^{-15}$ mho-cm$^{-1}$).

As a comparison, a carrier of substantially identical composition lo the above except that the coating polymer is a copolymer of 87 percent by weight styrene and 13 percent by weight butadiene, with a number average molecular weight of about 16,000 and a weight average molecular weight of about 140,000 was prepared by repeating the above. The final product was comprised of a carrier core with a total of 1.0 percent coating weight polymer of poly(styrene/butadiene) (87 percent/13 percent monomer ratio) by weight on the surface. A developer composition was then prepared in the same manner as above. Thereafter, the triboelectric charge on the carrier particles was determined by the known Faraday Cage process, and there was measured on the carrier a charge of 3.4 microcoulombs per gram.

EXAMPLE II

In the first step of the carrier coating process, 89.82 grams of the terpolymer of poly(styrene-co-butadiene-co-dimethylaminoethyl methacrylate DMAEMA) in a 84.75/10.5/4.75 weight percent monomer ratio and 8,982 grams of an irregular atomized steel core with a volume median diameter of 65 microns (Hoeganaes, Inc.) were mixed. The mixing and fusing process steps were accomplished using the same conditions as Example I. The final product was comprised of a carrier core with a total of 1.0 percent coating weight polymer of poly(styrene-co-butadiene-co-DMAEMA) (84.75 percent/10.5 percent/4.75 percent monomer ratio) by weight on the surface.

A developer composition was then prepared in the same manner as carrier Example I. Thereafter, the triboelectric charge on the carrier particles was determined by the known Faraday Cage process, and there was measured on the carrier a charge of 33.2 microcoulombs per gram. Further, the conductivity of the carrier as determined by forming a 0.1 inch long magnetic brush of the carrier particles, and measuring the conductivity by imposing a 10 volt potential across the brush was $4.67\times10^{-14}$ (mho-cm)$^{-1}$. Therefore, these carrier particles were insulative.

EXAMPLE III

In the first step of the carrier coating process, 44.91 grams of a terpolymer of poly(styrene-co-butadiene-co-dimethylaminoethyl methacrylate) in a 62.3/7.7/30 weight percent monomer ratio with a particle size of about 5.7 microns is mixed with 4,491.09 grams of a spherical steel core with a volume median diameter of 100 microns (Nuclear Metals, Inc.). Mixing and the remainder of the carrier coating process was accomplished in the same manner as Example I. The final product was comprised of a carrier core with a total of 1.0 percent by weight terpolymer of poly(styrene-co-butadiene-co-dimethylaminoethyl methacrylate) in a 62.3/7.7/30 weight percent monomer ratio on the surface of the carrier.

A developer composition was then prepared by the process of Example I. Thereafter, the triboelectric charge on the carrier particles was determined by the known Faraday Cage process, and it was believed that a high triboelectric value would be obtained, based on the measured difference between the triboelectric values of the carrier in Carrier Example I and that of the comparison example in Example I, in conjunction with the increase in climethylaminoethyl methacrylate concentration in this current Example. Specifically, it was believed that a triboelectric value of between 90 and 110 microcoulombs per gram would be obtained. Further, it was believed that the conductivity of the carrier, as determined by forming a 0.1 inch long magnetic brush of the carrier particles, and measuring the conductivity by imposing a 10 volt potential across the brush, would be too insulating to be measured ($>10^{-15}$ mho-cm$^{-1}$). Therefore, these carrier particles were insulative. Additional adjustments to the dimethylaminoethyl methacrylate concentration, specifically to values intermediate to the 4.75 percent concentration of Example I and the 30 percent concentration of this Example, were believed to yield triboelectric values of suitable magnitudes between about 18 and about 110 microcoulombs per gram.

A developer composition was then prepared by the process of Example I.

In all the Examples, the triboelectric charging values and the conductivity numbers were obtained in accordance with the aforementioned procedure. More specifically, the tribo was measured by the known Faraday Cage process and the conductivity was measured by forming a 0.1 inch long magnetic brush of the carrier particles, and measuring the conductivity by imposing a 10 volt potential across the brush.

Other embodiments and modifications of the present invention may occur to those of ordinary skill in the art subsequent to a review of the present application and the information presented herein; these embodiments and modifications, as well as equivalents thereof, are also included within the scope of the present invention.

What is claimed is:

1. A carrier comprised of a core, and thereover a polymer of styrene, a diolefin and a dialkylaminoalkyl methacrylate.

2. A carrier in accordance with claim 1 wherein said diolefin is of the formula $CH_2{=}CR{-}CR{=}CH_2$ where R is independently H or alkyl.

3. A carrier in accordance with claim 2 wherein said alkyl in the formula contains from about 4 to about 6 carbon atoms.

4. A carrier in accordance with claim 1 wherein said diolefin is 1,3-butadiene, isoprene, 2-methyl-1,3-butadiene, or 2,3-dimethyl-1,3-butadiene.

5. A carrier in accordance with claim 1 wherein alkyl contains from about 1 to about 6 carbon atoms.

6. A carrier in accordance with claim 1 wherein said polymer is a terpolymer of styrene, butadiene and dimethylaminoethyl methacrylate.

7. A carrier in accordance with claim 1 wherein the polymer is a terpolymer of styrene, butadiene and diisopropylaminoethyl methacrylate, a terpolymer of styrene, butadiene and diethylaminoethyl methacrylate, a terpolymer of styrene, isoprene, and dimethylaminoethyl methacrylate, or a terpolymer of styrene, 2,3-dimethyl-1,3-butadiene and diisopropylaminoethyl methacrylate.

8. A carrier in accordance with claim 1 wherein the polymer molecular weight $M_w$ is from about 30,000 to about 700,000, and wherein the number average molecular weight $M_n$ is from about 20,000 to about 300,000 as measured by Gel Permeation Chromatography.

9. A carrier in accordance with claim 1 wherein the polymer contains from about 75 to about 90 weight percent of styrene, from about 5 to about 15 weight percent of butadiene, and from about 2 to about 20 weight percent of said methacrylate.

10. A carrier in accordance with claim 1 wherein the polymer is of an $M_w$ of about 20,000 to about 800,000, and of an $M_n$ of from about 12,000 to about 350,000.

11. A carrier in accordance with claim 1 wherein the polymer coating weight is from about 0.1 to about 20 weight percent, and the carrier size is from about 50 to about 200 microns in volume average diameter.

12. A carrier in accordance with claim 1 wherein the polymer coating weight is from about 1 to about 3 weight percent.

13. A carrier in accordance with claim 1 wherein the polymer contains a conductive component.

14. A carrier in accordance with claim 13 wherein the conductive component is a metal oxide, or is carbon black, and the carrier conductivity ranges from about $10^{-5}$ mho/cm to about $10^{-6}$ mho/cm.

15. A carrier in accordance with claim 13 wherein said conductive component is carbon black selected in an amount of from about 10 to about 60 weight percent, and the conductivity thereof is from about $10^{-10}$ mho/cm to about $10^{-7}$ mho/cm.

16. A carrier in accordance with claim 1 wherein said core is a metal, a metal oxide, a ferrite, or mixtures thereof.

17. A carrier in accordance with claim 1 with a triboelectric charge on the carrier of from about a positive 20 to about a positive 100 microcoulombs per gram.

18. A developer comprised of the carrier of claim 1 and toner.

19. A developer in accordance with claim 18 wherein the toner is comprised of thermoplastic resin and colorant.

20. A developer in accordance with claim 19 wherein the colorant is a pigment, or a dye.

21. An imaging process comprising the development of an image with the developer of claim 18.

22. A carrier in accordance with claim 1 containing a second polymer.

23. A carrier in accordance with claim 22 wherein the second polymer is a fluoropolymer, a styrene polymer, a styrene acrylate copolymer, or a styrene methacrylate copolymer.

24. A carrier in accordance with claim 22 wherein said second polymer is comprised of a polyurethane, or polymethylmethacrylate.

25. A carrier in accordance with claim 1 wherein said core is spherical steel or atomized steel, magnetite, a ferrite of Cu/Zn-ferrite, Ni/Zn-ferrite, Sr (strontium)-ferrite, or Ba-ferrite.

26. A process for the preparation of the carrier of claim 1 which comprises mixing the core and the polymer to form said carrier.

27. A developer comprised of a (1) carrier core and a coating layer thereover of a terpolymer of styrene, a diolefin, and dimethylaminoethyl methacrylate, and (2) a toner.

28. A developer in accordance with claim 27 wherein the carrier core is iron or a ferrite, and said diolefin is butadiene.

29. A developer in accordance with claim 27 with a carrier triboelectric charge of from about a positive 50 to about a positive 75 microcoulombs per gram, and a toner triboelectric charge of from about a negative 50 to about a negative 75 microcoulombs per gram.

* * * * *